US005207345A

United States Patent [19]

Stewart et al.

[11] Patent Number: 5,207,345

[45] Date of Patent: May 4, 1993

[54] LID ADAPTER FOR BUCKET

[76] Inventors: Gene L. Stewart, 4335 Niagra Ave., San Diego, Calif. 92107; Gary S. Breed, 15220 Segovia Ct., San Diego, Calif. 92129

[21] Appl. No.: 911,773

[22] Filed: Jul. 10, 1992

[51] Int. Cl.[5] ..... B65D 51/18

[52] U.S. Cl. ..... 220/254; 220/304; 220/306; 220/308; 220/326; 220/212.5

[58] Field of Search ..... 220/254, 304, 306, 307, 220/308, 324, 326, 601, 634

[56] References Cited

U.S. PATENT DOCUMENTS

| | | | |
|---|---|---|---|
| 3,516,571 | 6/1970 | Roper et al. | 220/308 |
| 4,166,548 | 9/1979 | Crisci | 220/308 |
| 4,288,000 | 9/1981 | Luker et al. | 220/281 |
| 4,356,930 | 11/1982 | Roper | 220/306 |
| 4,416,197 | 11/1983 | Kehl | 110/214 |
| 4,573,605 | 3/1986 | Udell | 220/304 |
| 4,779,754 | 10/1988 | Ten Eyck et al. | 220/254 |
| 4,844,273 | 7/1989 | Hawkins | 215/329 |
| 4,874,103 | 10/1989 | Quisenberry et al. | 220/1 T |
| 4,949,865 | 8/1990 | Turner | 220/90.4 |
| 5,052,568 | 10/1991 | Simon | 215/250 |

*Primary Examiner*—Allan N. Shoap
*Assistant Examiner*—Nova Stucker
*Attorney, Agent, or Firm*—Nydegger & Associates

[57] ABSTRACT

A device is disclosed which provides an airtight seal for buckets and other containers not previously having a removable, easily resealable lid. The device consists of an adapter and a lid which is threaded into the adapter. The adapter is formed to drape over the rim of the container. A seal is located between the adapter and the rim and provides an airtight seal when compressed. The adapter is held in engagement with the container by a ridge which engages a lip on the rim of the container. The lid includes threads which engage threads in the adapter and a second seal is located between the adapter and the lid providing an airtight seal when compressed. In one embodiment, the lid drapes over the adapter and prevents the adapter from being disengaged from the bucket by preventing the adapter form deforming sufficiently to disengage from the rim.

17 Claims, 4 Drawing Sheets

LID ADAPTER FOR BUCKET

TECHNICAL FIELD

The present invention relates to devices providing airtight seals for containers. More particularly, the present invention pertains to providing an easily removable airtight lid for containers not originally designed to incorporate a lid. The present invention is particularly, although not exclusively, useful for providing a removable, airtight lid for buckets and the like.

BACKGROUND OF THE INVENTION

Today's modern society has the need to transport and contain liquid and solid materials in versatile containers. For various purposes, a variety of containers have been developed ranging in size from ocean going tankers to small cans and jars. One container that has been available for many years in a number of forms is a bucket.

Buckets are used for a number of applications, most of which involve short term storage of liquids or other materials. Examples of typical uses would include carrying water from a faucet to a remote location and carrying soil from one location to another. Both these uses involve short term placement of relatively stable materials in the bucket.

If less stable materials are placed in a bucket for longer periods, a simple bucket often will not suffice. For example, consider the storage of a petro-chemical solvent having a high rate of evaporation. This liquid, if left exposed to the open air, is soon depleted through evaporation. Many solids are subject to dispersion to the environment as well. One example is common fertilizer which loses effectiveness over time if left exposed to the open air. Still further, loss of fluids and solids can also occur during transportation. More specifically, liquids, because of their fluid nature, tend to slosh around when the container holding them is moved. If the sloshing is severe enough, the liquids can spill over the edge of the container. Even solids may be spilled if the container is tipped severely enough.

Typically, to avoid these problems a cover is fastened to the container. Container covers come in primarily two types, namely single use and reusable covers. Single use covers are those types which can be applied and removed only once whereas reusable covers can be used more than once. To reduce costs and to minimize waste, reusable covers may be preferred. In fact, many manufacturers design their containers to include reusable closures. Unfortunately, other containers are closureless and cannot accept available reusable lids.

A number of container covers have been developed in the past. One example is found in U.S. Pat. No. 4,416,197 issued for an invention entitled "Waste Material Compactor Apparatus" which describes a two-part cover. This reusable cover includes a lip member and a cover member which closes an opening in the lip member. On the other hand, this cover does not provide an airtight seal and the cover member merely lays on the lip member, but is not attached.

U.S. Pat. No. 4,874,103 for an invention entitled "Receptacle for Receiving Infectious Waste" describes another cover attachable to a container. This cover includes an opening with a door hinging inward. The door allows placement of materials into the container, but prevents future access to the materials within the container.

Other covers have been developed which are reclosable covers for use with buckets, but because of their designs, have openings which are relatively small. One example is disclosed in U.S. Pat. No. 4,288,000 entitled "Child-Resistant Lid" issued for a reusable cover intended to be child resistant. To accomplish this, the removable portion of the lid must be compressed around its circumference prior to unthreading. The design of the locking member requires that the outer diameter of the removable portion be small enough to be gripped by the hand of an adult. For this reason, the opening to the container will be slightly smaller than an adults hand. While this is sufficient for containing smaller items in the bucket, it substantially hinders access to the bucket's contents and is incompatible with items larger than the opening. Similar small opening closures are disclosed in U.S. Pat. No. 4,779,754 and U.S. Pat. No. 4,949,865.

These prior closures suffer from a number of drawbacks, namely they are not air-tight, are not reclosable or have an opening which significantly reduces the opening of the container.

In light of the above, it is an object of the present invention to provide a multiple use closure for containers. Another object of the present invention is to provide a closure system which can convert a container not previously having a closure to one which accepts a reusable closure. Further, it is an object of the present invention to provide an adaptable closure which is removable and allows ready access to the contents of the container. Still further, it is an object of the present invention to provide a closure which provides an airtight seal for containers not previously including a sealing means. Yet another object of the present invention is to provide a resealable closure which is useable for sealing liquids and solids in a container. And still another object of the present invention is to provide a reusable closure for containers which has an opening nearly as large as the opening of the container itself. Another object of the present invention is to provide a closure which is relatively easy to manufacture and which is comparatively economical.

SUMMARY OF THE INVENTION

The present invention provides an airtight, resealable closure for containers such as buckets and the like. Generally, the closure of the present invention includes an adapter which is engagable with the container and a lid which is engagable with the adapter. The closure is designed to allow the adapter to be attached to the top rim of the container to be sealed and to allow the lid to be threaded into the adapter to complete an airtight seal.

More specifically, the adapter is shaped to drape over the rim of the container around the rim's entire circumference. To accomplish this, the adapter has an inner and an outer skirt which are on the inner side and outer side of the rim, respectively. The outer skirt includes a ridge on the side of the skirt facing the container. This ridge is used to hold the adapter onto the rim of the container by engaging a lip on the rim. The material used in the adapter is a plastic or similar material which will stretch slightly to allow the ridge to just clear the lip of the rim and then return to its original shape.

To ensure an airtight seal, the adapter has a compressible seal located between the skirts. This seal contacts the rim of the container when the adapter is placed on the rim and compresses slightly as the adapter is pressed onto the container and the ridge on the outer skirt clears the lip of the rim.

The outer skirt in shaped such that it extends outwardly away from the container below the ridge leaving a gap between the adapter and the bucket. This outward extension is necessary because the adapter is not intended to be permanent, but instead is designed to be pried off the container if desired. Accordingly, the gap is sufficiently wide to allow entry of a prying tool or the fingers of a person.

The inner skirt, on its side facing the center of the container, includes female threads to engage corresponding male threads on the lid.

The lid is generally a circular disk sized to fit a circular opening in the adapter. Included on the main portion of the lid is a handle to allow gripping and turning during threading and unthreading of the lid. In one embodiment, the lid includes an inverted L-shaped annulus which extends upwardly then outwardly from the main portion of the lid. The upwardly extending portion of the L-shaped annulus has, on the side facing the adapter, the male threads to engage the female threads on the adapter. The L-shaped annulus also includes a seal attached to the side facing the adapter. In this embodiment, the lid is threaded into the adapter until the seal is compressed between the L-shaped annulus and a shoulder on the inner skirt of the adapter. Once the adapter is engaged onto the rim of the container and the lid is threaded into the adapter, the container is airtightly sealed.

In an alternative embodiment, the inner skirt of the adapter does not require a shoulder to engage the seal between the lid and the adapter. In this version, the lid includes a downward facing U-shaped annulus instead of the L-shaped annulus of the previously described embodiment. The U-shaped annulus is attached to the main portion of the lid in a manner similar to the attachment of the L-shaped annulus to the main portion of the lid.

The U-shaped annulus is sized and shaped to drape over the adapter which, in turn, is draped over the rim of the container. Accordingly, the U-shaped annulus has an inner extension and an outer extension which are positioned adjacent the skirts of the adapter.

An added benefit of the outer extension is that it is of sufficient length to contact the outer skirt's outward extension when the lid is installed in the adapter. This contact prevents the adapter from stretching to allow the ridge on the outer skirt to clear the lip of the rim. In this manner the adapter is locked onto the rim of the container providing an airtight seal.

BRIEF DESCRIPTION OF THE DRAWINGS

The novel features of this invention, as well as the invention itself, both as to its structure and its operation will be best understood from the accompanying drawings, taken in conjunction with the accompanying description, in which similar reference characters refer to similar parts, and in which.

DESCRIPTION OF PREFERRED EMBODIMENTS

Figure 1:
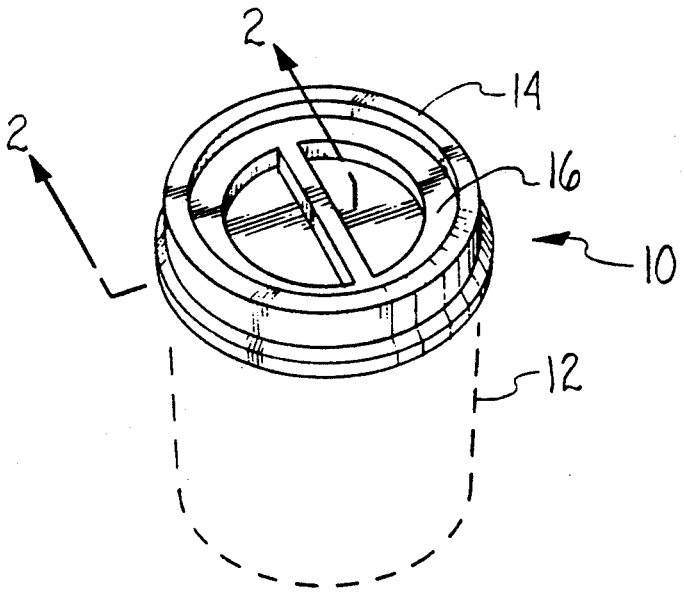
FIG. 1 is a perspective view of the present invention installed on a bucket.

Referring initially to FIG. 1, the closure of the present invention is shown and generally designated 10. As shown in Fig. 1, the closure 10 is a lid-like member adapted to be installed on a bucket 12 or other similar container. The closure 10 includes an adapter 14 and a lid 16.

Figure 2:
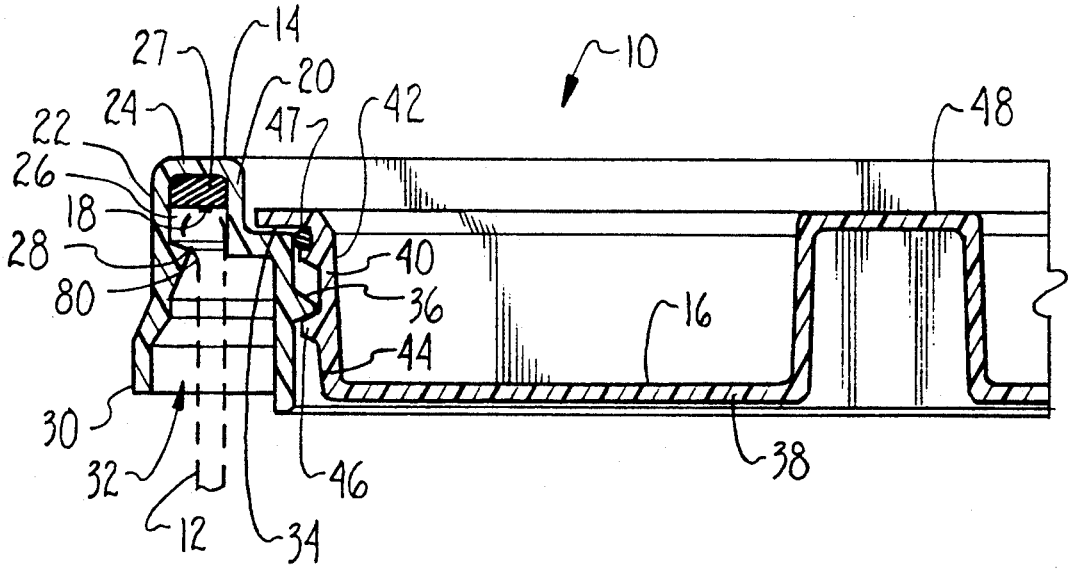
FIG. 2 is a partial cross-sectional view of the device of the present invention installed on a bucket as seen along line 2—2.

Referring now to FIG. 2, the detailed structure of the closure 10 including the adapter 14 and the lid 16 is shown as installed on a bucket 12. Adapter 14 is sized and shaped to drape over the rim 18 of the bucket 12. If bucket 12 has a round rim 18, then the adapter 14 will be generally round as well. Likewise, if the rim 18 is rectangular, then the adapter 14 is rectangular. The adapter 14 has an inner skirt 20, an outer skirt 22 and a crown portion 24 which connects the inner and outer skirts 20 and 22. The configuration of the skirts 20 and 22 and the crown portion 24 leaves a recess 26. A compressible seal 27 is located in the recess 26. Seal 27 is preferably a soft plastic or rubber material which can provide an airtight seal when compressed. Outer skirt 22 is formed to include an inner ridge 28. Inner ridge 28 is designed to create a narrowing of recess 26. The distal end of outer skirt 22 has an outwardly extending portion 30 which is an extension of outer skirt 22 deflected outward in a direction away from the bucket 12. The magnitude of the deflection and the length of the outwardly extending portion must be such that a prying tool such as a screwdriver or a person's fingers can enter the resulting gap 32 between the outer skirt 22 and the bucket 12. Adapter 14 is preferably made from a slightly deformable or stretchable material such as a soft plastic or a hard rubber. The inner skirt 20 includes a shoulder 34 and supports female threads. The preferred threads would have a inward facing ridge 36. A those skilled in the art can appreciate, multiple standard threads could be supported on inner skirt 20 without departing from the scope of the invention. However, having a large single thread system provides easier and quicker threading and is best suited for this device.

As noted above, the closure provides a lid 16 which is threadably attachable to the adapter 14. Lid 16 has a main portion 38 and an inverted L-shaped annulus 40. L-shaped annulus 40 has an inner side 42 and an outer side 44. Inner side 42 is fixably attached to the main portion 38. Outer side 44 supports the male threads corresponding to the female threads on the inner skirt 20. The male threads on the outer side are preferably comprised of a large channel 46 which has the same dimensions and pitch as ridge 36. Outer side 44 further supports a seal 47 which is preferably made of a soft plastic or rubber material which can provide an airtight seal when compressed. While FIG. shows the seal as an o-ring type seal it could also be a disk type seal without departing from the scope of the present invention. The main portion 38 of the lid 16 is formed to include a handle 48 having suitable dimensions to facilitate gripping and turning of the lid 16.

Figure 3:
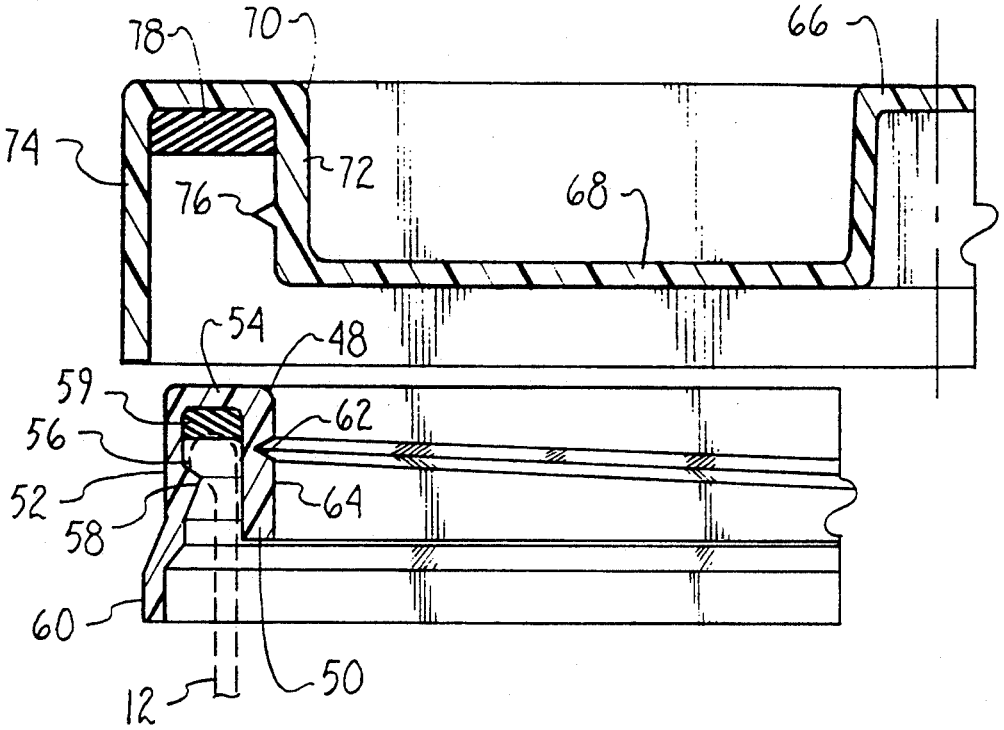
FIG. 3 is a partial cross-sectional view of an alternative embodiment of the present invention where the adapter is installed on a bucket, but the lid is not yet threaded into the adapter.

Referring now to FIG. 3, an alternative embodiment of the present invention including a locking mechanism to prevent unintentional disengagement between the rim 18 and the adapter 48 is shown. Adapter 48 is slightly different from adapter 14, although it has inner skirt 50, outer skirt 52, crown portion 54 connecting skirts 50 and 52, recess 56 and seal 59. Outer skirt 52 includes inner ridge 58 and outwardly extending portion 60. Inner skirt 50 includes female threads, although in this embodiment they are preferably a single channel 62 on the inner side 63 of the inner skirt 50. This embodiment does not require a shoulder on the inner skirt 50 because the lid 64 is modified as well. Like lid 16, lid 64 is formed to include a handle 66 in the main portion 68. Attached to the peripheral edge of main portion 68 is an inverted U-shaped annulus 70. U-shaped annulus 70 is sized and shaped to be draped over adapter 48 when the lid is in the closed position. U-shaped annulus 70 has an inner extension 72 and an outer extension 74. Inner extension 72 is fixably attached to the main portion 68 of the lid 64. Inner extension 72 also includes male threads, preferably a ridge 76 corresponding to female threads 62 on adapter 48. A seal 78 is located in the cavity between the inner extension 72 and outer extension 74. Outer extension 74 has sufficient length to contact the outwardly extending portion 60 of adapter 48 to provide the locking mechanism of the present embodiment.

Figure 4:
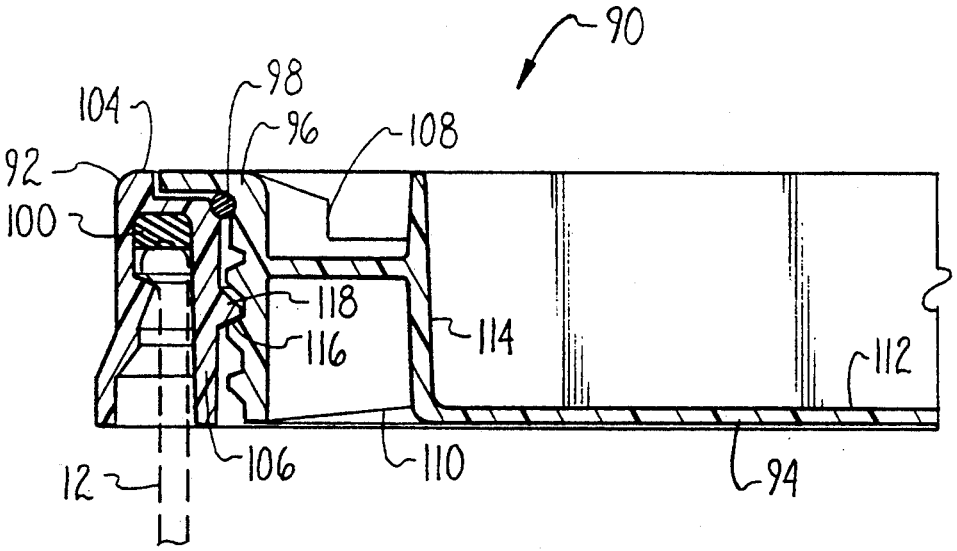
FIG. 4 is a partial cross-sectional view of an alternative embodiment of the present invention, as would be seen along the line 2—2, where the adapter is installed on a bucket.

Referring now to FIG. 4 another embodiment of the device of the present invention is shown and designated 90. This embodiment includes an adapter 92, a lid 94, an L-shaped annulus 96 and seals 98 and 100. Adapter 92 includes a shoulder 102 which is cut out of the crown portion 104 and inner skirt 106. This embodiment shows structural ribs 108 and 110 which strengthen the lid 94. A plurality of these ribs are placed around the lid 94. The main portion 112 of lid 94 is attached to the L-shaped annulus 96 by a T-shaped annulus 114. L-shaped annulus 96 forms male threads 116 corresponding to female threads 118 formed on the adapter 92. Similar to the previous embodiments, the lid 94 threadably attaches to adapter 92 providing an airtight seal.

Figure 5:
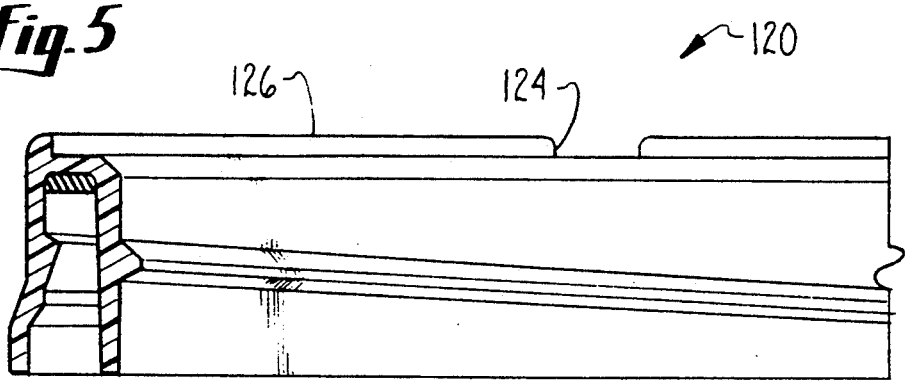
FIG. 5 is a partial cross-sectional view of an alternate embodiment of the adapter of the present invention.
Figure 6:
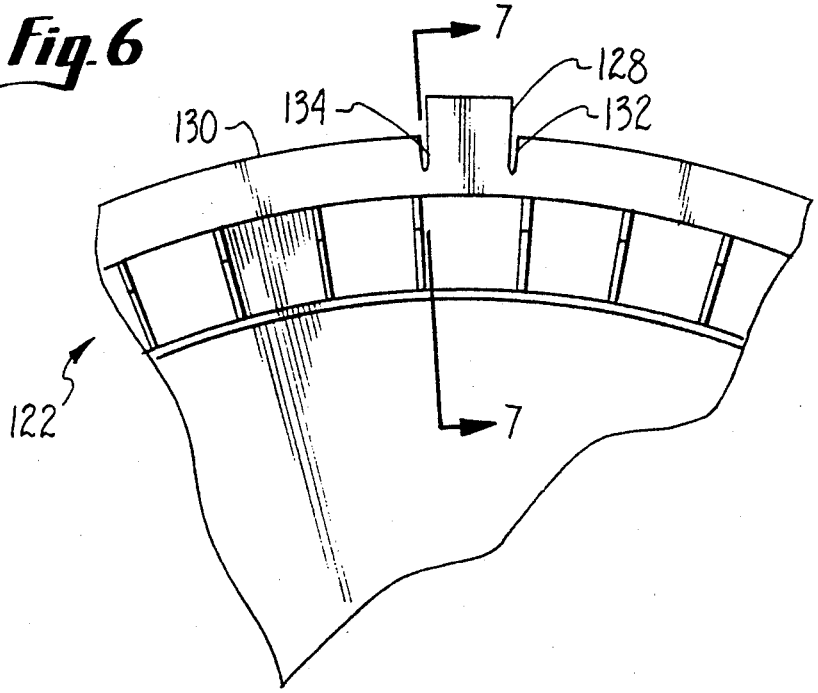
FIG. 6 is a partial top view of the lid to be used with the adapter shown in FIG. 5.
Figure 7:
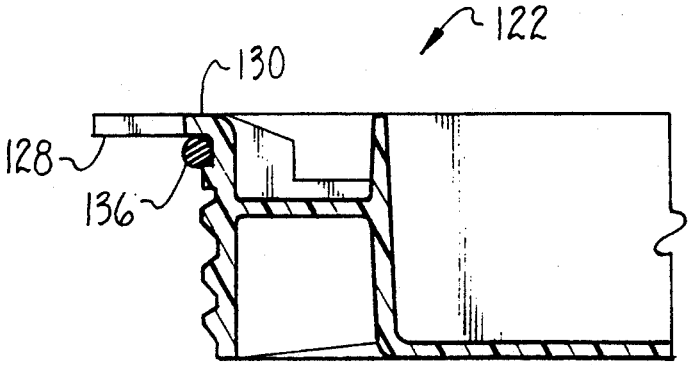
FIG. 7 is a partial cross section of the lid shown in FIG. 6 along line 7—7.

Referring now to FIGS. 5–7 another embodiment is shown including an adapter 120, a lid 122. This embodiment is generally the same as the embodiment shown in FIG. 4 except that this embodiment includes a locking means. The locking means includes a notch 124 in the crown portion 126 of the adapter 120, and a tab 128 extending out from the inverted L-shaped annulus 130 of the lid 122. As those skilled in the art will appreciate, it is within the scope of the present invention to include several notches 124 around the crown portion 126 to prevent over-compression of the seal 136.

L-shaped annulus 130 is formed to include slots 132 and 134 which cut into the L-shaped annulus 130 on both sides of tab 128. Slots 132 and 134 allow tab 128 to flex independent of L-shaped annulus 130.

Figure 8:
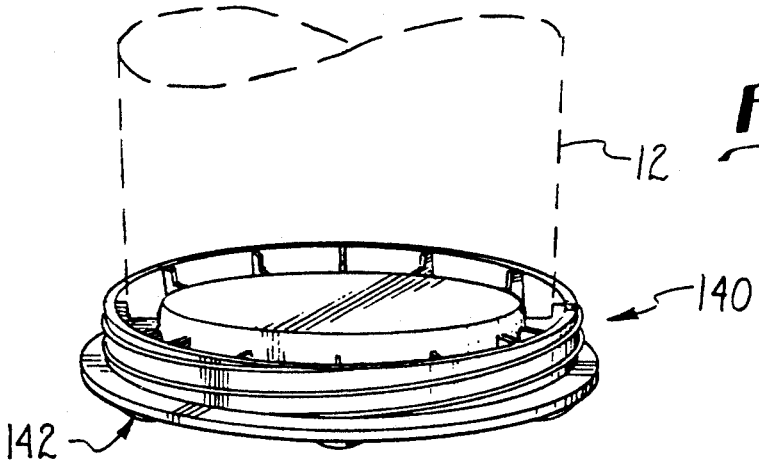
FIG. 8 is a perspective view of the lid portion of the present invention attached to the base of a bucket.
Figure 9:
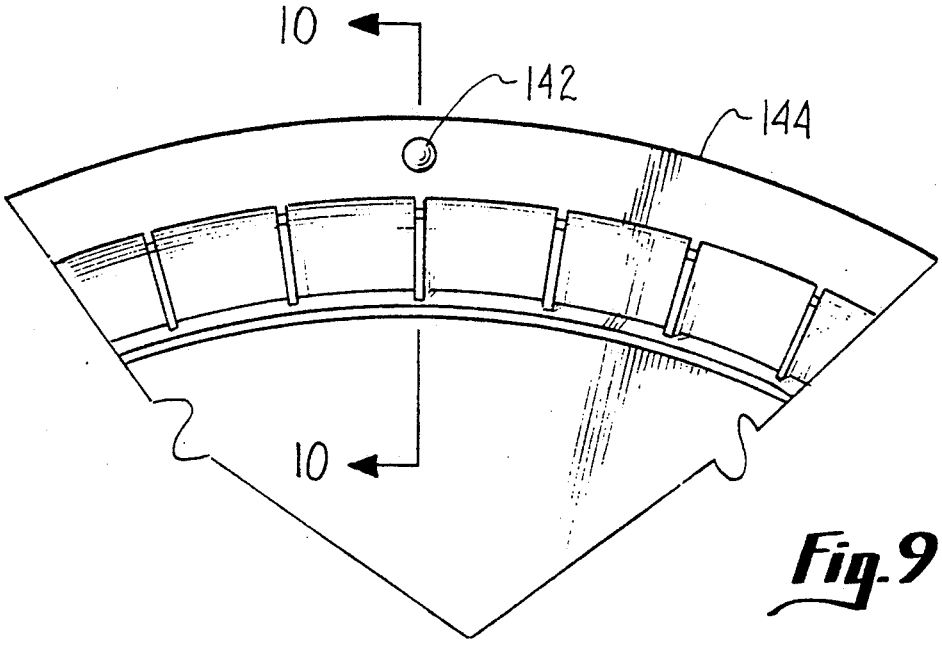
FIG. 9 is a partial top view of the lid shown in FIG. 8.

Referring now to FIG. 8, another embodiment of the lid of the present invention is shown and generally designated 140. Lid 140 is shown inverted and attached to the bottom of bucket 12. Lid 140 includes three or more glides 142 which contact the ground when lid 140 is inverted. Glides 142 are preferably equally spaced around the top of lid 140. The placement of a particular glide 142 on lid 140 can be seen in FIG. 9. Glide 142 is preferrably a protrusion of the L-shaped annulus 144. Glides 142 are included to facilitate sliding lid 140 and bucket 12 along the surface on which they are placed.

Figure 10:
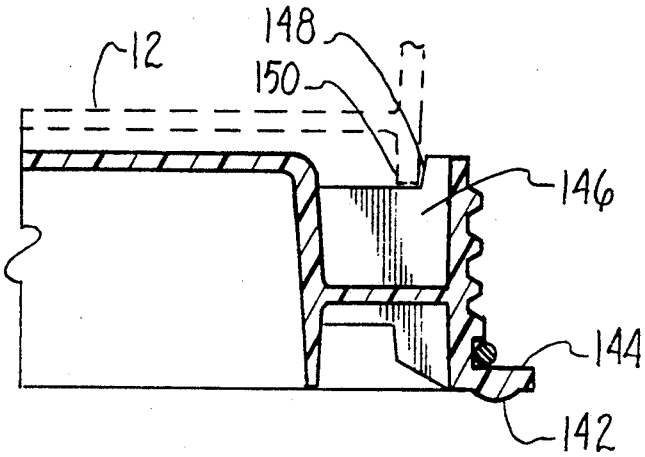
FIG. 10 is a partial cross section of the lid shown in FIG. 9 along line 10—10.

Referring now to FIG. 10, lid 140 is shown inverted and attached to bucket 12 (phantom). Lid 140 includes a plurality of substantially equally spaced ribs 146 having a modified edges 148. It is this modification to the ribs which allows the bottom of bucket 12 to be inserted into lid 140. Edges 148 are shaped to engage a skirt 150 at the bottom of bucket 12. Bucket 12 is retained by lid 140 as a result of friction produced by the contact forces between the ribs 146 and skirt 150.

OPERATION

The present invention discloses a device providing a reclosable airtight seal for a container such as a bucket. To seal the bucket using the embodiment shown in FIG. 2, the adapter 14 is placed on the rim 18 of the bucket 12 such that the rim 18 enters gap 32 until it butts against inner ridge 28. Increasing pressure is then applied to the adapter in a direction toward the bucket until the outer skirt deforms slightly outward allowing lip 80 to clear inner ridge 28. When lip 80 clears ridge 28, rim 18 enters recess 26 and compresses seal 27. Lid 16 is positioned in the opening of adapter 14 to threadably engage ridge 36 With channel 46. Lid 16 is then rotated until seal 47 is sufficiently compressed between shoulder 34 and L-shaped annulus 40 to provide an airtight seal. To access the contents of the container, lid 16 can be unthreaded and removed. To remove the entire device, the outer skirt is deformed outward by inserting fingers or other prying tools into gap 32. Once the outer skirt is deformed a sufficient amount, lip 80 of rim 18 clears inner ridge 28 and adapter 14 can be removed. The embodiments shown in FIGS. 4 and 8–10 operate in substantially the same manner.

The embodiment including the locking mechanism shown in FIG. 3 operates similarly except that seal 78 is compressed between crown portion 54 and U-shaped annulus 70. Additionally, when lid 64 is threaded into adapter 48, outer extension 74 contacts outwardly extending portion 60 of outer skirt 52. This is the locking mechanism. Accordingly, to remove the adapter 48 from the bucket 12, lid 64 must be removed prior to deforming the outer skirt 52 otherwise outer extension 74 will prevent deformation of the outwardly extending portion 60.

The embodiment of the present invention shown in FIGS. 5–7 operates in substantially the same manner as the embodiments shown in FIGS. 2 and 4 except a locking means is included. More particularly, lid 122 threads into adapter 120 compressing seal 136. Threading is continued until tab 128 falls into notch 124 and prevents further threading. To unthread lid 122 from adapter 120, tab 128 must be manually pried upward to allow the tab 128 to clear notch 124.

While the particular airtight closure as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A device providing an airtight seal for a bucket having a bottom, a lip and a rim defining an opening, said device comprising:

an adapter comprising an inner skirt, an outer skirt, and a crown portion connecting said skirts, said skirts and said crown portion defining a recess for releasably engaging said rim of said bucket, said adapter defining an opening substantially as large as said opening of said bucket, said outer skirt forming an outwardly extending portion, said outwardly extending portion allowing entry between said bucket and said outwardly extending portion to facilitate removal of said adapter from said bucket, said outer skirt forming an inner ridge engageable with said lip of said bucket to prevent unintentional disengagement of said adapter from said bucket;

a lid threadably attachable to said inner skirt, said lid establishing a closed configuration for said device when said lid is attached to said inner skirt, said lid comprising a handle portion, a main portion and a substantially L-shaped annulus, said annulus having an inner side and an outer side, said inner side being fixedly attached to said main portion, said outer side of said annulus having threads formed therein; and a first airtight sealing member between said adapter and said lid.

2. The device as recited in claim 1 wherein said inner skirt comprises threads for threadably engaging said threads in said annulus.

3. The device as recited in claim 2 wherein said inner skirt further forms a shoulder for airtight engagement with said first airtight sealing member.

4. The device as recited in claim 3 wherein a second airtight sealing member is located between said adapter and said bucket.

5. The device as recited in claim 4 wherein said L-shaped annulus includes an outwardly extending tab and said crown portion of said adapter is formed to include at least one notch to retainingly receive said tab, said notch receiving said tab when said device is in said closed configuration.

6. The device as recited in claim 4 wherein said L-shaped annulus includes a top surface formed with at least three glides protruding therefrom.

7. The device as recited in claim 6 wherein said main portion of said lid has a bucket facing side, said device further comprising a plurality of ribs connecting said L-shaped annulus and said bucket facing side of said main portion, each of said ribs having an edge shaped to receive said bottom of said bucket.

8. A device providing an airtight seal for a bucket having a bottom, a lip and a rim defining an opening, said device comprising:

an adapter comprising an inner skirt, an outer skirt, and a crown portion connecting said skirts, said skirts and said crown portion defining a recess for releasably engaging said rim of said bucket, said adapter defining an opening substantially as large as said opening of said bucket, said outer skirt forming an outwardly extending portion, said outwardly extending portion allowing entry between said bucket and said outwardly extending portion to facilitate removal of said adapter from said bucket, said outer skirt forming an inner ridge engageable with said lip of said bucket to prevent unintentional disengagement of said adapter from said bucket;

a lid threadably attachable to said inner skirt, said lid establishing a closed configuration for said device when said lid is attached to said inner skirt, said lid including a handle portion;

a substantially U-shaped annulus having an inner extension and an outer extension, said extension defining a recess therebetween, said inner extension being fixably attached to said lid; and a first airtight sealing member between said adapter and said lid.

9. The device as recited in claim 8 further comprising a second sealing member located in said recess of said U-shaped annulus.

10. The device as recited in claim 9 wherein said recess is sized to receive said crown portion of said adapter when said device is in said closed configuration.

11. The device as recited in claim 10 wherein said outer extension has sufficient length to prevent disengagement of said adapter from said bucket, said outer extension contacting said outwardly extending portion and restricting deformation thereof when said device is in said closed configuration.

12. The device as recited in claim 11 wherein said inner skirt has threads formed therein and said inner extension has threads formed therein for threadable engagement with said threads in said inner skirt.

13. A device for providing an airtight seal for a bucket comprising:

an attaching means for releasably attaching said device to a bucket;

a lid being threadably engageable with said attaching means, said lid having a first position where said lid is removed from said attaching means and a second position where said lid is engaged with said attaching means;

a means on said lid for preventing release of said attaching means from said bucket;

a first means for sealing between said lid and said attaching means, said first means for sealing providing an airtight seal when said lid is in said second position; and a second means for sealing between said attaching means and said bucket, said second means for sealing providing an airtight seal when said attaching means is attached to said bucket.

14. The device as recited in claim 13 wherein said attaching means comprises a substantially U-shaped annulus having an inner skirt and an outer skirt defining a recess therebetween for releasably receiving said bucket.

15. The device as recited in claim 14 wherein said outer skirt forms an outwardly extending portion and an inner ridge, said outwardly extending portion allowing entry between said bucket and said outwardly extending portion to facilitate removal of said attaching means from said bucket.

16. The device as recited in claim 15 wherein said outer skirt forms an inner ridge, said inner ridge engaging a lip on said bucket to prevent unintentional disengagement of said adapter from said bucket.

17. The device as recited in claim 16 wherein said lid further comprises a handle portion.

* * * * *